United States Patent [19]

Prunbauer

[11] 4,250,725

[45] Feb. 17, 1981

[54] CONTROL DEVICE

[75] Inventor: Kurt Prunbauer, Herzogenburg, Austria

[73] Assignee: Evva Werk Spezialerzeugung von Zylinder- und Sicherheitsschlössern Gesellschaft m.b.H. & Co., Austria

[21] Appl. No.: 9,694

[22] Filed: Feb. 5, 1979

[30] Foreign Application Priority Data

Feb. 9, 1978 [AT] Austria ..... 918/78

[51] Int. Cl.[3] ..... E05B 9/04; E05B 47/00

[52] U.S. Cl. ..... 70/276; 70/356; 70/365; 70/386; 70/421; 70/358

[58] Field of Search ..... 70/276, 386, 365, 356, 70/421, 360, DIG. 75, 358, 376

[56] References Cited

U.S. PATENT DOCUMENTS

| | | | |
|---|---|---|---|
| 347,445 | 8/1886 | Sherman | 70/421 X |
| 1,135,027 | 4/1915 | Kohlberger | 70/DIG. 75 |
| 1,513,718 | 10/1924 | Morehouse | 70/386 X |
| 2,023,847 | 12/1935 | Liss | 70/421 X |
| 2,287,175 | 6/1942 | Heyer | 70/421 X |
| 2,393,428 | 1/1946 | Stroud | 70/276 |
| 2,460,615 | 2/1949 | Andrew | 70/386 X |
| 3,499,303 | 3/1970 | Spain | 70/421 X |
| 3,570,287 | 3/1971 | Hallmann | 70/276 |
| 3,654,782 | 4/1972 | Heimann | 70/276 |
| 3,928,993 | 12/1975 | Epstein | 70/386 X |
| 3,935,720 | 2/1976 | Boving | 70/356 X |
| 4,084,416 | 4/1978 | Prunbauer | 70/356 X |

FOREIGN PATENT DOCUMENTS

| | | | |
|---|---|---|---|
| 2349760 | 4/1975 | Fed. Rep. of Germany | 70/276 |
| 2711061 | 9/1977 | Fed. Rep. of Germany | 70/276 |
| 504473 | 7/1920 | France | 70/421 |

*Primary Examiner*—James T. McCall
*Assistant Examiner*—Carl F. Pietruszka
*Attorney, Agent, or Firm*—Michael J. Striker

[57] ABSTRACT

The plug of a cylindrical lock includes at each side of its key channel a blind boring communicating with a conical recess in an arresting plate secured to the housing of the lock. The blind boring intersects cylindrical rotary control members arranged for rotation in the plug and each having a diametrical passage coinciding in one angular position thereof with the blind boring. A series of arresting balls is arranged in the blind boring and in respective passages in such a manner as to resume in the aligned position of the members a blocking position in which the terminal ball is in engagement with the conical recess. During the rotation of the plug by a correct key the arresting balls are shifted by the inclined surfaces of the conical recess into the blind boring and the plug is free to rotate. By the insertion of a wrong key at least one passage is misaligned and consequently the terminal arresting ball cannot be removed from its arresting recess.

10 Claims, 8 Drawing Figures

CONTROL DEVICE

BACKGROUND OF THE INVENTION

The present invention relates in general to control devices, and in particular to a control device for use with a cylinder lock having a cylindrical case or housing and a cylindrical plug arranged in the housing and being angularly adjustable relative to the latter. The cylindrical plug has a key channel extending along its center axis for receiving a magnetically coded key. The key activates a plurality of cylindrical control members arranged for rotation about their axis along the key channel. The cylindrical plug is connected to a conventional lock bolt.

SUMMARY OF THE INVENTION

The object of the present invention is to provide an improved control device for magnetic locks of the abovedescribed type which improves the arresting of the cylindrical plug relative to its housing when a wrong key is inserted.

Another object of this invention is to provide such an improved control device which renders it more difficult to detect the magnetic coding of the lock.

In keeping with these objects, and others which will become apparent hereafter, one feature of the invention resides, in a control device for use with magnetic locks of the aforedescribed type, in a combination which comprises a blind boring extending through the plug parallel to the key channel and through the rotary cylindrical members, each of the rotary cylindrical members defining a diametrical passage corresponding to the blind boring and being in one angular position of the rotary member in alignment with the boring, an arresting member facing the plug opposite the blind boring, and a plurality of arresting elements preferably in the form of magnetizable balls arranged in the blind boring and in the passages of the cylindrical members in such a manner that in the aligned position of the passages with the boring the arresting balls are shiftable between a blocking position in which one of the elements engages the arresting member while the other elements are confined in respective passages to permit a free rotation of the rotary members, and an unblocking position in which the one arresting element is disengaged from the arresting member and the other elements partially project from the passages to arrest the rotary cylindrical members in their aligned position. In this aligned position, it is possible to rotate the cylindrical plug relative to the housing.

In the preferred embodiment of this invention, the arresting member is in the form of an arresting plate having a conical recess facing the boring and in the blocking position of the arresting element the one element partially enters the conical recess thus arresting the cylindrical plug against rotation. In a modification of this invention, the arresting elements in respective passages of the cylindrical rotary members can be in the form of bolts held in a central position in respective passages by resilient pins.

In still another modification the arresting plate itself is rotatably mounted relative to the housing and is held in position by means of a spring-biased ball or pin engaging two recesses of the periphery of the arresting plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
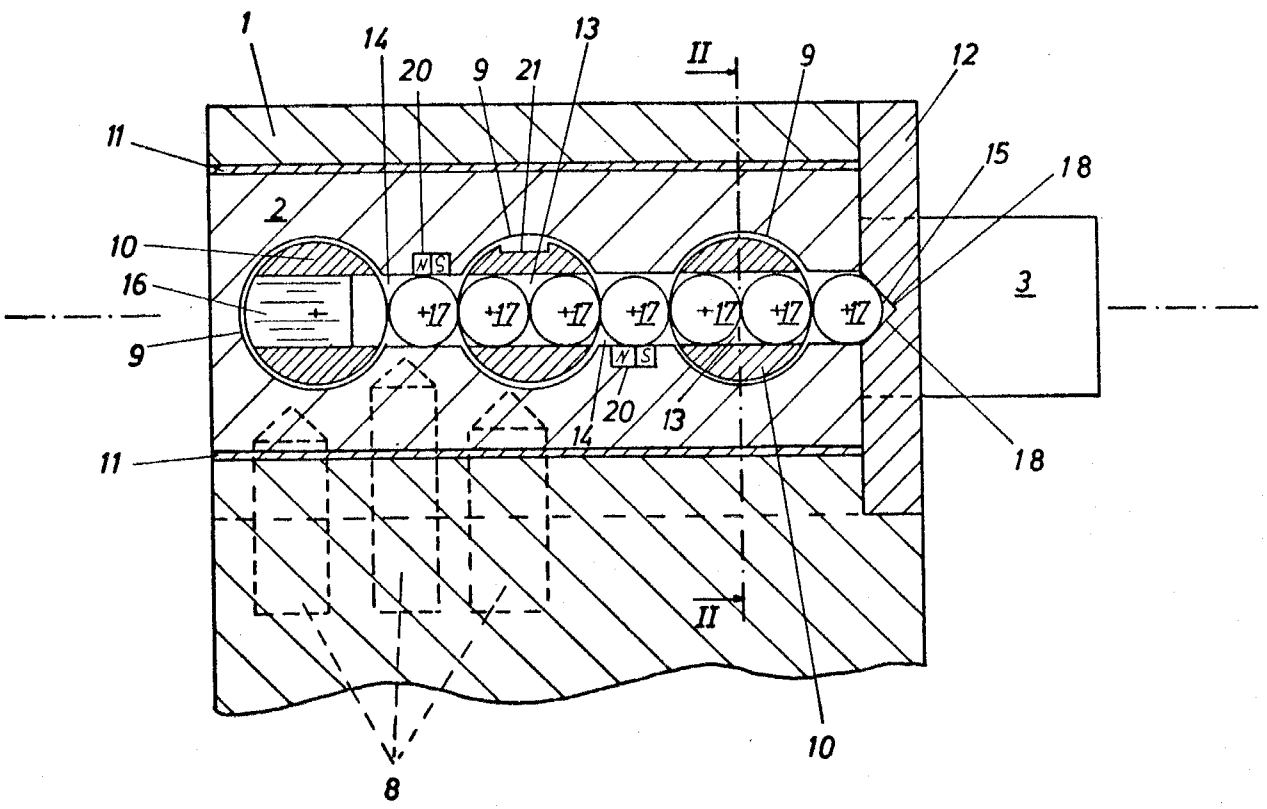
FIG. 1 is a sectional side view taken along the line I—I of FIG. 2 of a schematically illustrated cylinder lock including the controlling device of this invention.
Figure 2:
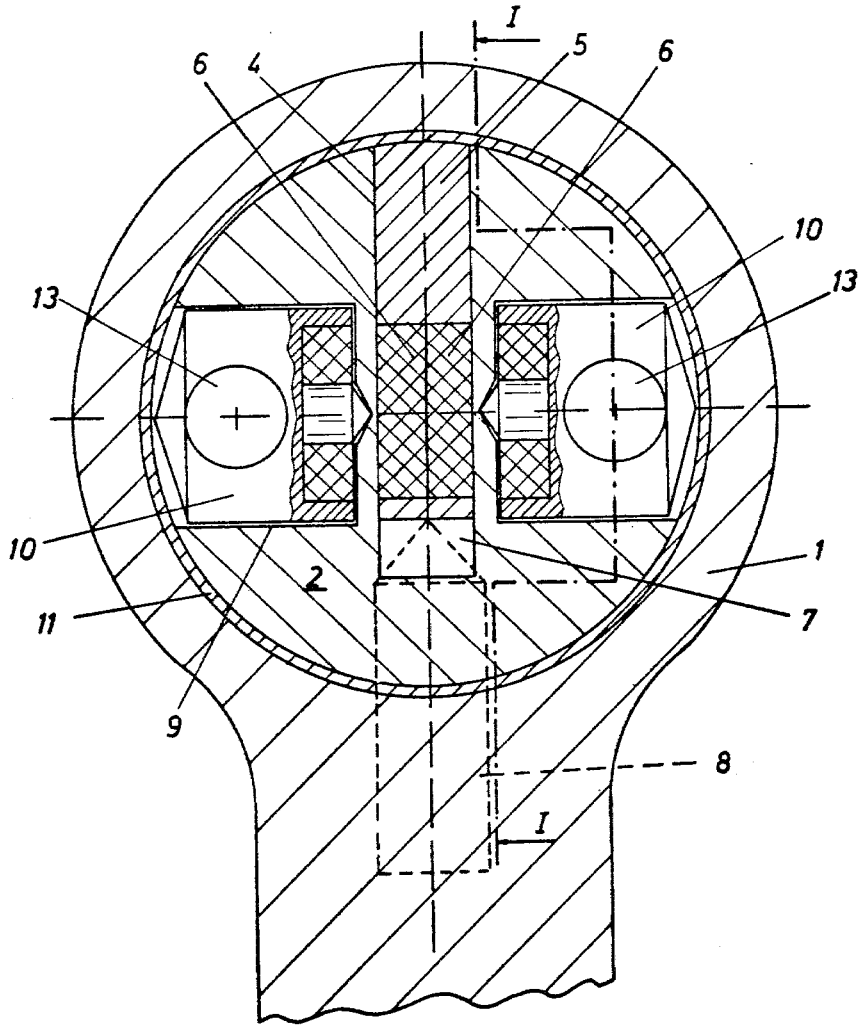
FIG. 2 is a sectional rear view taken along the line II—II of the device as illustrated in FIG. 1.
Figure 3:
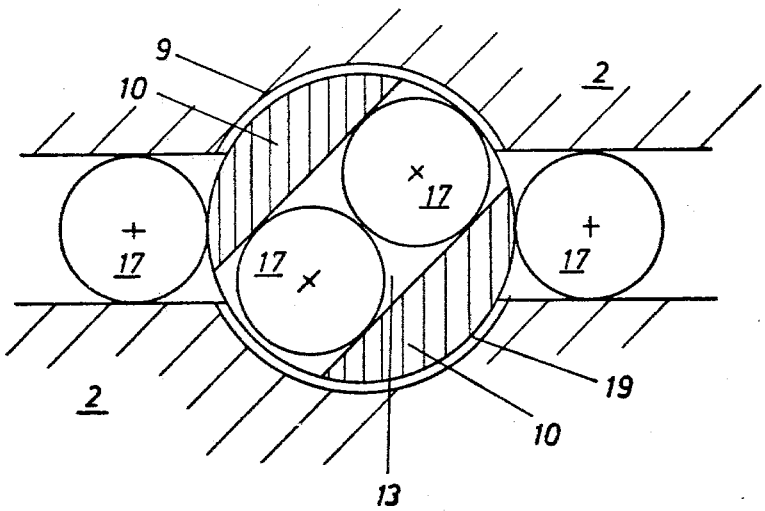
FIG. 3 is a detailed cut-away view of the control device of FIG. 1 shown on an enlarged scale in its blocking position.

Referring now to FIGS. 1–3, the cylinder lock according to this invention has a case or housing 1 in which cylindrical plug 2 is supported for rotation about its center axis and is connected to a conventional locking bolt 3. A key channel 4 as illustrated in FIG. 2, extends in axial direction through the plug 2 and a magnetically coded key 5 is insertable into the key channel 4. In addition to the magnetic coding, key 5 can also be provided with recesses 7 which cooperate in a well-known manner with tumbler pins 8 schematically illustrated in FIG. 2 by dash lines. At both sides of key channel 4 there are arranged magnetic rotary members 10 each supported for rotation about a center axis of a blind bore 9. Preferably the magnetic rotary members are provided with bearing points supported in corresponding conical recesses in each blind bore 9. Sleeve 11 of a slidable material is provided between housing 1 and cylindrical plug 2. In the embodiment shown in FIG. 1, the end of housing 1 adjoining bolt 3 is closed by means of arresting plate 12 rigidly connected to the housing. The arresting plate has a central hole for permitting the passage of the bolt 3. Each magnetic rotary member 10 has a diagonal passage 13 which in a predetermined angular position of member 10 is in alignment with each other and with blind boring 14 which extends in plug 2 parallel to the key channel 4. In this example, two blind borings 14 are provided at opposite sides of the key channel and each boring 14 communicates at one end with conical recess 15 in arresting plate 12. Passage 9 of rotary member 10 at the other end of blind boring 14 is closed by means of a bolt 16. Arresting elements in the form of magnetizable balls 17 are arranged in respective blind borings 14 and passages 13. The diameter of balls 17 corresponds substantially to the diameter of each passage 13 and boring 14 whereby the ratio of the diameters of the balls to the length of the diametrical passage 13 in each rotary member 10 is dimensioned such that always a given number of the arresting balls 17 occupies the entire passage 13. In the example of FIG. 1 there are always two balls which fully occupy the passage 13.

If a correctly coded key 5 is inserted into key channel 4 the magnetic rotary members 10 are brought into an angular position in which the passages 13 are in alignment with blind boring 14 as illustrated in FIG. 1. If in this aligned position of the passages and of arresting elements 17 the key is turned to rotate the cylindrical plug 2 relative to housing 1 and arresting plate 12, the terminal arresting ball 17 which engages the conical recess 15 is urged against the inclined surface 18 of the recess and consequently is partially shifted into the adjoining passage 13 of rotary member 10. In this manner cylindrical plug 2 becomes unblocked and key 5 can complete the rotation of the plug with the bolt 3 into or from their operative position. Due to the fact that all arresting balls 17 in blind boring 14 and passages 9 are brought in close contact with each other by means of positioning magnets 20, for example, the terminal ball 17 thus displaces during the turning of the key all remaining arresting balls 17 to the left so that the corresponding balls partially enter the adjoining passage and partially remain in blind boring 14.

If a wrong key is inserted into key channel 4, so at least one of magnetic rotary members 10 takes an angular position in which its passage 13 is out of alignment with blind boring 14 (FIG. 3). As a consequence, the terminal arresting ball 17 cannot be displaced from the conical recess 15 because the other balls 17 abut against the peripheral wall 19 of the misaligned rotary member 10. Consequently, the wrong key cannot turn plug 2 and bolt 3 relative to housing 1. As mentioned above, positioning magnets 20 are arranged in operative proximity to balls 17 to blind boring 14 so as to magnetically urge the series of the arresting bolts 17 into their blocking position in which the terminal ball 17 is in engagement with the inclined walls 18 of control recess 15. In addition, peripheral walls 19 of respective rotary members 10 can be provided with recesses 21 which complicate the scanning of the code of the lock.

Figure 4:
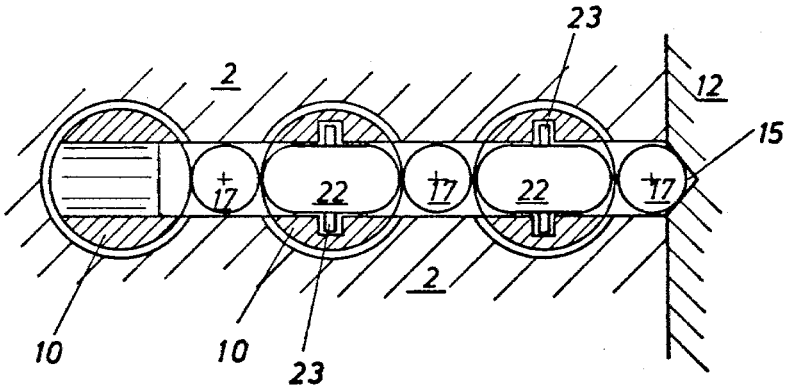
FIG. 4 is a sectional side view illustrating a modification of the control device of this invention.
Figure 5:
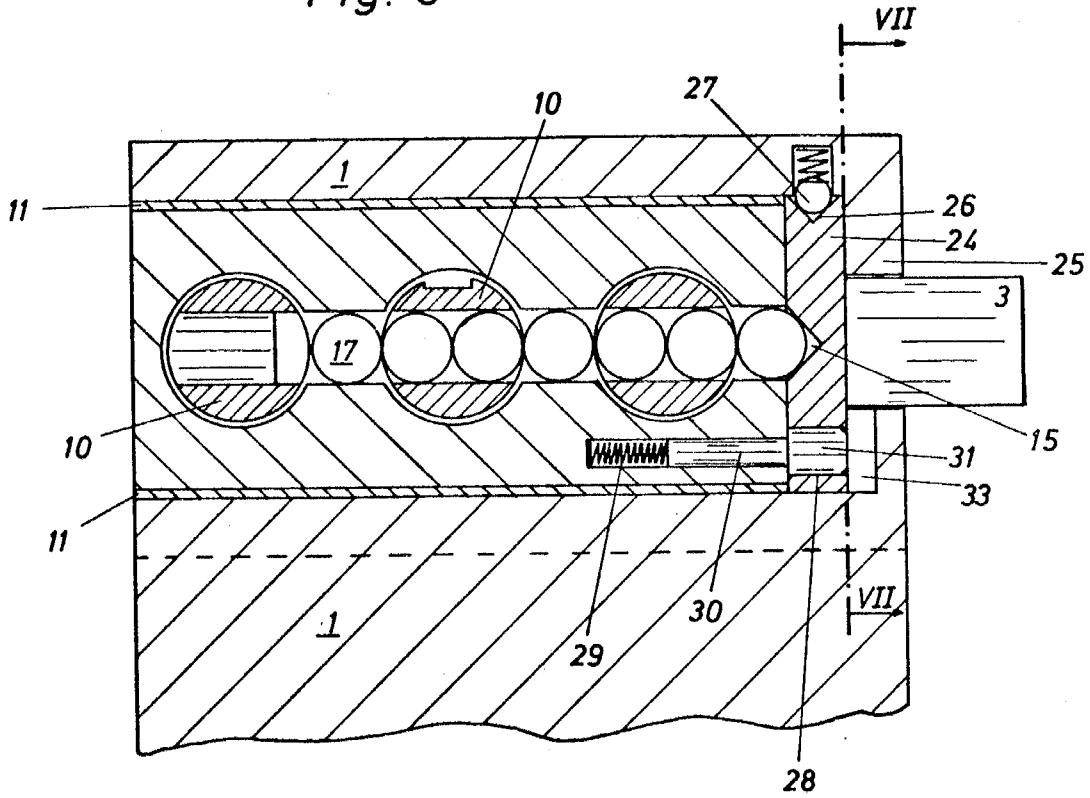
FIG. 5 is a sectional side view of still another modification of this invention taken along the line V—V of FIG. 6.
Figure 6:
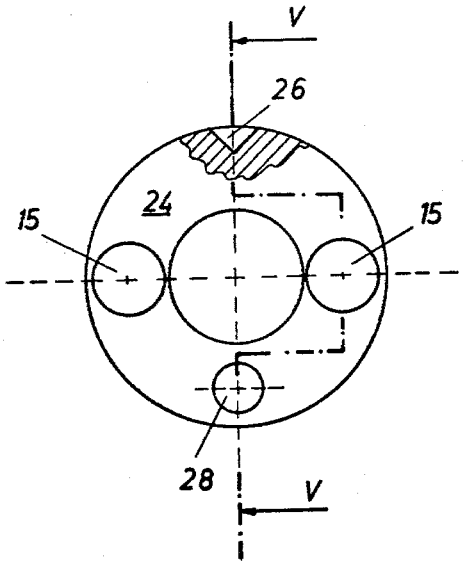
FIG. 6 is a rear view of the annular arresting plate of FIG. 5.

In a modification according to FIG. 4 the arresting elements taking place in respective passage 13 of rotary members 10 are in the form of elongated bolts 22 having spherical ends and extending over the entire length of the passage 13. The arresting bolts 22 are held in a center position in the passage 13 by means of resilient pins 23 engaging corresponding recesses in member 10. The resilient pins 23 permit the displacement about a predetermined amount to the left or to the right.

Figure 8:
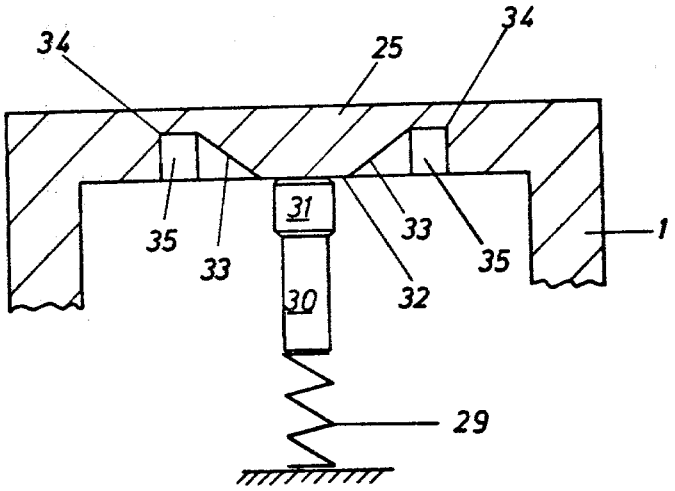
FIG. 8 is a cut-away sectional view taken along the line VIII—VIII of FIG. 7.
Figure 7:
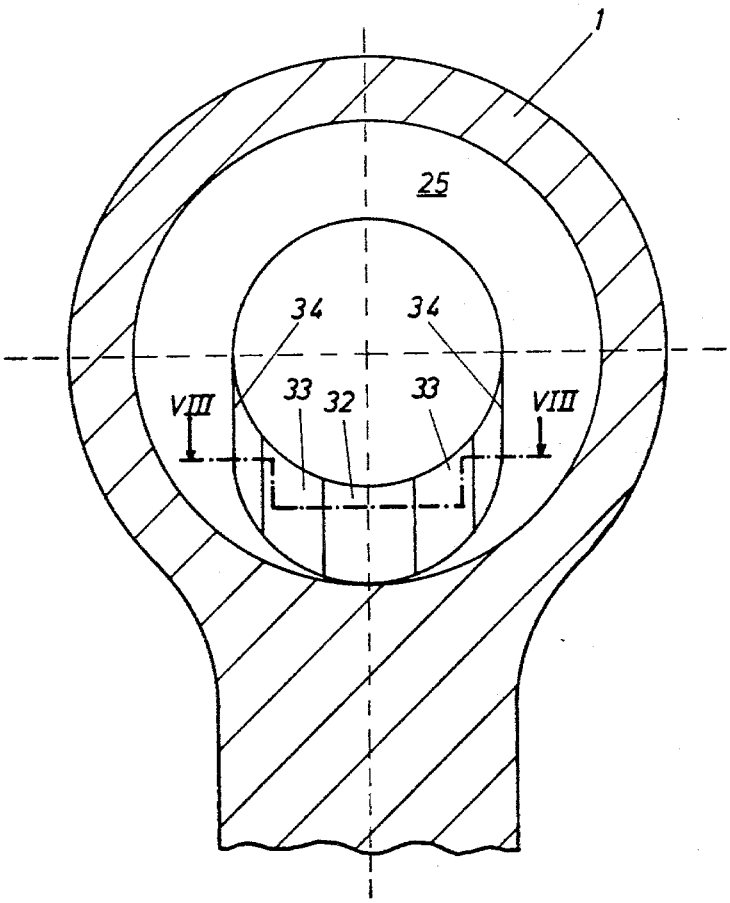
FIG. 7 is a rear view of the end plate of the housing taken along the line VII—VII of FIG. 5.

In certain cases it is of advantage to intercept the relatively strong forces exerted during the turning of the cylindrical plug 2 by a wrong key as might otherwise transmit the forces via arresting balls 17 to magnetic rotary members 10. For this purpose the modified embodiment as illustrated in FIGS. 5–8 includes arresting plate 24 which is rotatably mounted relative to housing 1 and cylindrical plug 2. The rotatable arresting plate 24 is situated between the face of plug 2 and a terminal plate 25 connected to housing 1 and is bounded by the cylindrical inner wall portion of the housing 1. As seen from FIG. 6, the cylindrical peripheral wall of arresting plate 24 is provided with a conical recess 26 for engaging spring-biased stop ball 27 and diametrically opposed to the stop ball 27 there is provided an axially directed bore 28. In addition, the arresting plate 24 includes the conical recesses 15 arranged at both sides of the central opening as it has been described above. The bore 28 cooperates with a two-segment bolt 30 and 31 projecting into an aligned blind boring in plug 2 and being spring-biased by spiral spring 29 against the terminal plate 25. As illustrated in FIG. 8, the segment 31 of the locking bolt bears against a profiled surface portion of the terminal plate 25.

If a correctly coded key is used, the balls 17 are displaced to the left out of engagement from arresting recesses 15 in the same manner as described above and plug 2 is free to rotate together with biasing spring 29 and bolts 30. The arresting plate 24 with the upper bolt segment 31, however, is retained in its original position by the action of stop ball 27. As seen from FIG. 8, the bolt segment 31 bears upon the flat central part 32 of sloping cam surfaces 33 in the end plate 25.

In the event, however, that an incorrectly coded key is inserted into the key channel so similarly as in the preceding example, at least one magnetic rotary member 10 is brought into a misaligned position according to FIG. 3 and the terminal arresting ball 17 remains in the arresting conical recess 15. As a consequence, when turning plug 2 by an incorrect key the arresting plate is taken along by means of the engaged terminal ball 17 to the point at which the resistance of the spring biased stop ball 27 is overcome. Due to the pressure of biasing spring 29 acting against the two segments 30 and 31, the latter are shifted outwardly along the inclined surfaces 33 until they abut against stop surface 34 and prevent any further rotation of the plug 2.

It will be understood that each of the elements described above, or two or more together, may also find a useful application in other types of constructions differing from the types described above.

While the invention has been illustrated and described as embodied in a magnetically controlled cylindrical plug, it is not intended to be limited to the details shown, since various modifications and structural changes may be made without departing in any way from the spirit of the present invention. For example, this invention can also be used in connection with a rim lock having a slidable lock bolt. It is also within the scope of this invention to make the arresting elements of a non-magnetizable material such as of brass, for example, which are spring-biased to eliminate disturbances caused by any magnetic interference.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control device for use with cylindrical locks, comprising a housing; a cylindrical plug arranged for rotation about its axis in said housing; a plurality of rotary control members arranged for rotation in said plug; a blind boring extending through said plug and crossing said rotary members, each of said rotary members defining a diametrical passage corresponding to said blind boring; means for bringing said rotary members into an aligned angular position in which said passages are in alignment with said blind boring; arresting means connectable to said housing and facing said plug opposite to said blind boring; a plurality of arresting elements arranged in said blind boring and in said passages; and means for urging during said aligned position of said control members said arresting elements into a blocking position in which the outermost blocking elements engage said arresting means, said arresting means being operable to urge said arresting elements into said blind boring when said plug is rotated about its axis.

2. The device as defined in claim 1, wherein said arresting elements are balls and the length of respective diametrical passages corresponds to an integral multiple to the diameter of said balls.

3. The device as defined in claim 1, wherein at least a part of said arresting elements have the form of bolts resiliently held in a central position in said diametrical passages.

4. The device as defined in claim 1, wherein said arresting elements are of magnetizable material and said means for urging said elements into said blocking position are magnets arranged along said blind boring.

5. The device as defined in claim 1, wherein said arresting means is an arresting plate secured to said housing and defining a conical recess facing said blind boring and cooperating with the terminal arresting element.

6. The device as defined in claim 1, wherein said arresting means is an arresting disk rotatably supported in said housing opposite the free base of said cylindrical plug.

7. The device as defined in claim 6, wherein an arresting latch is provided between the periphery of said arresting disk and the inner wall of said housing.

8. The device as defined in claim 7, wherein said arresting disk includes an axially directed bore, a two-segmented bolt having its lower segment arranged in a corresponding boring in said plug and its top segment in said bore, said housing including a terminal plate defining at least one stop surface cooperating with said top segment of said bolt to arrest said rotary arresting disk in a fixed position relative to said housing.

9. The device as defined in claim 1, wherein said cylindrical plug includes an axial key channel and said rotary control members are magnetically coded.

10. The device as defined in claim 9, further including spring-biased tumbler pins for cooperating with conventional recesses provided in said magnetically coded key.

* * * * *

UNITED STATES PATENT AND TRADEMARK OFFICE

CERTIFICATE OF CORRECTION

PATENT NO. : 4,250,725

DATED : February 17, 1981

INVENTOR(S) : Kurt Prunbauer

It is certified that error appears in the above-identified patent and that said Letters Patent are hereby corrected as shown below:

[73] The name of the Assignee should read

EVVA-Werk Spezialerzeugung von Zylinder- und Sicherheitsschlössern Gesellschaft m.b.H. & Co. Kommanditgesellschaft Signed and Sealed this

*Eleventh* Day of *August 1981*

[SEAL]

*Attest:*

GERALD J. MOSSINGHOFF

*Attesting Officer*

*Commissioner of Patents and Trademarks*